US008511578B2

(12) United States Patent
Has

(10) Patent No.: US 8,511,578 B2
(45) Date of Patent: Aug. 20, 2013

(54) VAPOR EXTRACTION APPARATUS HAVING AN EXTENDED RANGE OF FUNCTIONS

(75) Inventor: Uwe Has, Unterneukirchen-Oberschroffen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 928 days.

(21) Appl. No.: 10/994,948

(22) Filed: Nov. 22, 2004

(65) Prior Publication Data

US 2005/0150387 A1 Jul. 14, 2005

Related U.S. Application Data

(63) Continuation of application No. PCT/EP03/05077, filed on May 14, 2003.

(30) Foreign Application Priority Data

May 21, 2002 (DE) ..... 102 22 407

(51) Int. Cl.
*F23N 3/00* (2006.01)
*B05C 15/00* (2006.01)
*F24C 15/20* (2006.01)

(52) U.S. Cl.
USPC ..... 236/45; 454/49; 126/299 R

(58) Field of Classification Search
USPC ..... 454/49; 96/407; 126/229 D, 229 R, 126/299 D, 299 R; 236/45
See application file for complete search history.

(56) References Cited

U.S. PATENT DOCUMENTS

| | | | | |
|---|---|---|---|---|
| 3,690,245 | A * | 9/1972 | Ferlise et al. | 126/299 D |
| 4,040,042 | A * | 8/1977 | Mayer | 454/340 |
| 4,790,862 | A | 12/1988 | Naruo et al. | |
| 5,273,060 | A | 12/1993 | Hill, III et al. | |
| 6,170,480 | B1 * | 1/2001 | Melink et al. | 126/299 R |
| 6,574,979 | B2 * | 6/2003 | Faqih | 62/285 |

FOREIGN PATENT DOCUMENTS

| | | | |
|---|---|---|---|
| DE | 77 36 725 | | 3/1978 |
| DE | 30 39 246 | A1 | 5/1982 |
| DE | 3039246 | A1 * | 5/1982 |
| DE | 37 28 308 | A1 | 3/1988 |
| DE | 39 22 090 | A1 | 1/1991 |
| JP | 59035743 | A | 2/1984 |
| JP | 01041722 | A | 2/1989 |
| JP | 05187695 | A * | 7/1993 |

* cited by examiner

*Primary Examiner* — Chen Wen Jiang
(74) *Attorney, Agent, or Firm* — James E. Howard; Andre Pallapies

(57) ABSTRACT

In order to extend the functionalities of a range hood, the range hood is provided with an oxygen sensor measuring the oxygen content in the ambient air. Alternatively or additionally, the range hood can be provided with a climate control device that regulates the air climate and/or room climate around the range hood and by which information about the climate below as well as around the range hood can be obtained and used or supplied for further processing.

25 Claims, 1 Drawing Sheet

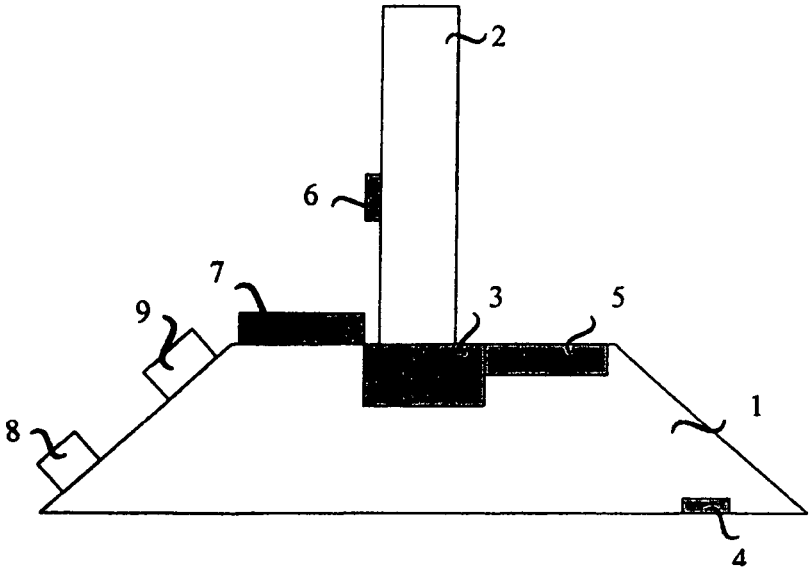
2
6
7
3
5
9
1
8
4

VAPOR EXTRACTION APPARATUS HAVING AN EXTENDED RANGE OF FUNCTIONS

CROSS-REFERENCE TO RELATED APPLICATION

This is a continuing application, under 35 U.S.C. §120, of copending international application No. PCT/EP03/05077, filed May 14, 2003, which designated the United States; this application also claims the priority, under 35 U.S.C. §119, of German patent application No. 102 22 407.2, filed May 21, 2002; the prior applications are herewith incorporated by reference in their entirety.

BACKGROUND OF THE INVENTION

Field of the Invention

The present invention relates to a vapor extraction apparatus having a blower device for moving air, a sensor device for detecting a measured value relating to the area surrounding the vapor extraction hood, and a control device for controlling the blower device on the basis of the detected measured value.

Vapor extraction hoods are generally used to divert the vapors that are produced during cooking away from the stove top or from the oven, or else out of the respective kitchen area.

However, vapor extraction hoods are also known which are equipped with various sensors in order to monitor what is happening on the stove or oven disposed beneath the sensors and to be able to draw conclusions about the current need for ventilation from the obtained findings using a suitable electronic system.

Therefore, measured values that are obtained at the vapor extraction hood can allow conclusions to be drawn about the progress of heating operations on the stove top or in the oven. These conclusions can be used to control the heating operations such that the heating operations can be carried out, for example, with the minimum amount of power, in the minimum amount of time or optimized in other ways. It is therefore possible to provide an extended range of functions with the vapor extraction hood according to the invention and to increase the living and working comfort in the kitchen and also to take over safety functions.

Furthermore, German Utility Model DE 77 36 725, for example, discloses an extraction hood in which at least one sensor, which responds when a fixed concentration of decomposition products is exceeded, is fitted between the extraction pipe and the range outlet within or below the space covered by the extraction hood. The sensor contains a gas-sensitive semiconductor element that responds to oxidizable gases such as hydrogen, carbon monoxide, aliphatic compounds or solvent vapors.

Moreover, Published, Non-Prosecuted German Patent Application DE 39 22 090 A1 discloses a vapor extraction hood for stoves and ovens in which a group of vapor extraction temperature sensors is disposed in a position associated with the cooking point on a suction surface which covers the vapor extraction region in order to detect temperature fluctuations above the cooking points. An equal number of room temperature sensors are provided on an outer face of the vapor extraction hood in order to detect the room temperature. The two groups of temperature sensors are combined in order to form a vapor extraction signal and a room temperature signal. A difference signal formed from these signals is used for the two-stage control of the extractor fan. The room sensor thus supplies a set-point value for controlling the fan.

Furthermore, Published, Non-Prosecuted German Patent Application DE 30 39 246 A1 discloses a vapor extraction hood that has at least one sensor element that responds to moisture, vapor, smoke and/or heat and faces the cooker surface. The vapor extraction hood may also be equipped with an optical or acoustic warning device that can be switched on by the control device once predefined set-point values have been exceeded. The atmosphere above the respective stove can be regulated by the vapor extraction hood. Difference values are also calculated in this case, one of the sensors in each case supplying a corresponding set-point value to the vapor extraction hood.

Finally, Published, Non-Prosecuted German Patent Application DE 37 28 308 A1 (corresponding to U.S. Pat. No. 4,790,862) discloses an air purification appliance that is used in residential buildings and offices. A UV radiation sensor and a gas sensor are used together in order to begin to purify the air immediately, for example after a cigarette has been lit in a room. If no UV radiation signal is received, but rather a specific gas concentration, the purification operation is likewise initiated. In this case, the air is purified by suitable filters.

SUMMARY OF THE INVENTION

It is accordingly an object of the invention to provide a vapor extraction apparatus having an extended range of functions that overcomes the above-mentioned disadvantages of the prior art devices of this general type, which extends the range of functions of the vapor extraction hoods.

According to the invention, the object is achieved by a vapor extraction apparatus having a blower device for moving air, a sensor device for detecting a measured value relating to an area surrounding the vapor extraction hood, and a control device for controlling the blower device on the basis of the detected measured value. It is possible for the oxygen content to be detected as the measured value by the sensor device.

The above-mentioned object is further achieved by a vapor extraction apparatus having a blower device for moving air, a sensor device for detecting a measured value relating to the area surrounding the vapor extraction hood, and a control device for controlling the blower device on the basis of the detected measured value. In addition, an air-conditioning regulating device is provided for regulating the air and/or room climate in the area surrounding the vapor extraction hood.

Other features which are considered as characteristic for the invention are set forth in the appended claims.

Although the invention is illustrated and described herein as embodied in a vapor extraction apparatus having an extended range of functions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is an illustration of a vapor extraction hood according to the invention.

DESCRIPTION OF THE PREFERRED EMBODIMENTS

Referring now to the single FIGURE of the drawing in detail, there is shown a vapor extraction hood 1 with a vapor extraction pipe 2. A blower device 3 which is not illustrated in detail sucks up from a cooking point the vapors which are produced beneath the vapor extraction hood 1 and conveys them through the vapor extraction pipe 2 in filtered or unfiltered form. A sensor device or a sensor 4 detects gases and vapors that rise, or are sucked, into the vapor extraction hood 1. A measurement signal of the sensor 4 is evaluated in a control device 5. The control device 5 activates the blower device 3 in accordance with specific predefined settings on the basis of the measured value received from the sensor 4.

A second sensor 6 is fitted to the vapor extraction pipe 2 in order to detect measured values from the area surrounding the vapor extraction hood 1. Such measured values may be physical measured values, such as temperature, pressure, light etc., or else chemical measured values, such as type and concentration of gases or vapors. An air-conditioning regulating device 7 is activated by the measurement signal from the second sensor 6. The vapor extraction hood 1 therefore has the additional functionality of an air-conditioning system for the kitchen or the room in which the vapor extraction hood is located.

In the illustration, the sensors 4 and 6 are fitted to the lower end of the vapor extraction hood 1 and, respectively, to the vapor extraction pipe 2. The position of the sensors is therefore indicated only symbolically, and any expedient position on the vapor extraction hood 1 or on the vapor extraction pipe 2 may be chosen. Moreover, further sensors for controlling the blower device 3 and/or the air-conditioning regulating device 7 may also be fitted to the vapor extraction hood 1 and/or to the vapor extraction pipe 2.

The sensors 4, 6 that are fitted to or in the vapor extraction hood 1 and/or the vapor extraction pipe 2 can be used not only to control the vapor extraction hood 1 but also to monitor the kitchen and/or the entire home. Therefore, information can be obtained not only about the processes taking place in the area influenced by the stove or oven, but also about the ambient air and/or the environmental conditions, in order to control other appliances as well. As a result, the living and working comfort and also safety in the kitchen and/or in the entire household may be increased.

In particular, the vapor extraction hood 1 may be equipped with one or more humidity and temperature sensors, by which the currently existing climate data in the kitchen can be established and the vapor extraction hood can correspondingly regulate the climate in the kitchen. The humidity and the temperature in the kitchen can be influenced by an air connection to the outside, in which case not only a discharge air connection, but also an intake air connection, should be provided.

The vapor extraction hood 1 may in particular be equipped with a moisture separator 8 by which moisture can be removed from the air in the kitchen. A humidifier 9 may therefore be provided on or in the vapor extraction hood 1 in order to correspondingly increase the humidity in the room.

In the same way, the vapor extraction hood 1 may be provided with a heating or cooling device in order to regulate the temperature in the room by a temperature sensor. The vapor extraction hood 1 thus has all the basic functionalities of an air-conditioning system. As already mentioned, any desired gas sensors may be fitted in or to the vapor extraction hood 1. As a result, disturbing odors may in some circumstances be detected, depending on the concentration. The kitchen and/or the home can be rapidly ventilated by corresponding activation of the blower device 3 in order to eliminate this disturbance.

As already mentioned, the gas sensor 4, 6 may, for example, be an oxygen sensor for monitoring the oxygen content of the air to be inhaled. It may therefore be expedient, for example, to monitor the oxygen content in a kitchen in which a very large number of persons are working. Fresh air can be conveyed into the room on the basis of the oxygen measurement signal by a suitable supply device that may be integrated in an external appliance or in the vapor extraction hood.

The air to be inhaled in the kitchen may also be monitored for concentrations of harmful substances with the aid of gas sensors. Therefore, ventilation can be maximized, for example when a combustible gas such as bottled gas, natural gas or coke oven gas is present, in order to prevent poisoning.

In rooms with chimney connections, a vapor extraction hood can reverse the direction of flow in the chimney on account of its suction action. This may result, for example, in increased concentrations of carbon monoxide, nitrogen oxides, smoke and the like. Special sensors may be provided for this purpose. In order to eliminate or to minimize this effect of increased concentrations of harmful substances, the vapor extraction hood 1 must reduce its blower power in a suitable manner. It is also expedient to immediately switch off the ventilation if such sensors have detected a fire in the building.

In addition to regulating the blower power, the sensors may also be used to control a warning device on the vapor extraction hood 1. The vapor extraction hood 1 may therefore have, for example, a warning buzzer or a warning lamp 8 in order to indicate an existing hazard in an acoustic or optical manner.

Furthermore, it is expedient for the vapor extraction hood to have a connection to an existing domestic electronic system in order to initiate the switching off or the activation of relevant domestic appliances in said domestic electronic system in the event of a hazard. There may also be a connection to remote data connections in order to ensure remote monitoring or remote control in the region of the vapor extraction hood.

In conjunction with the embodiments according to invention, the vapor extraction apparatus has always been spoken of as a vapor extraction hood 1. The vapor extraction apparatus may however also be in the form of a suction device integrated in the worktop or adjacent wall.

I claim:

1. A vapor extraction hood comprising:

a housing;

an exhaust air connection located on the housing and configured to connect to an exhaust air conduit for exhausting air out of the vapor extraction hood;

a blower device mounted on the housing and fluidly connected to the exhaust air connection and configured to generate a flow of gas through the exhaust air connection;

an ambient condition sensor for detecting at least one parameter of gas in an area surrounding the vapor extraction hood;

an extracted vapor condition sensor for detecting at least one parameter of gas within the vapor extraction hood;

at least one air-conditioning device mounted on the housing and configured to adjust the at least one parameter being detected by the ambient condition sensor;

an air-conditioning regulating device configured to control the at least one air-conditioning device based on the at least one parameter detected by the ambient condition sensor; and a control device for controlling the blower device based on the at least one parameter detected by the extracted vapor condition sensor.

2. The vapor extraction hood according to claim 1, wherein the at least one air-conditioning device includes a humidity adjusting device.

3. The vapor extraction hood of claim 2, wherein the at least one air conditioning device includes an air temperature adjusting device.

4. The vapor extraction hood of claim 3, wherein the humidity adjusting device includes a humidifier and a moisture separator.

5. The vapor extraction hood of claim 4, wherein the temperature adjusting device includes a heating device and a cooling device.

6. The vapor extraction hood of claim 1, further comprising an intake air connection fluidly connected to outside air.

7. The vapor extraction hood of claim 6, wherein the at least one parameter detected by the ambient condition sensor and/or the at least one parameter detected by the ambient condition sensor include an oxygen level.

8. The vapor extraction hood of claim 7, wherein the control device or the air-conditioning regulating device is configured to regulate the flow of air through the intake air connection based on the oxygen level.

9. The vapor extraction hood of claim 8, wherein the at least one parameter detected by the ambient condition sensor and/or the at least one parameter detected by the ambient condition sensor include a concentration of organic and/or inorganic gases and/or vapors.

10. The vapor extraction hood of claim 9, further comprising an acoustic and/or optical warning device configured to output a warning signal in a manner controlled by the control device when a predefined parameter set-point value is exceeded.

11. A vapor extraction assembly comprising:

a vapor extraction hood having an intake side and an exhaust side opposite the intake side;

an exhaust air conduit connected to the exhaust side and configured to exhaust air out of the vapor extraction hood;

a blower device fluidly connected to the exhaust air conduit and configured to generate a flow of gas through the exhaust air conduit;

an ambient condition sensor for detecting at least one parameter of gas in an area surrounding the vapor extraction hood;

an extracted vapor condition sensor for detecting at least one parameter of gas within the vapor extraction hood;

at least one air-conditioning device mounted to the vapor extraction hood and configured to adjust the at least one parameter being detected by the ambient condition sensor;

an air-conditioning regulating device configured to control the at least one air-conditioning device based on the at least one parameter detected by the ambient condition sensor; and a control device for controlling the blower device based on the at least one parameter detected by the extracted vapor condition sensor.

12. The vapor extraction assembly according to claim 11, wherein the at least one air-conditioning device includes a humidity adjusting device and/or an air temperature adjusting device.

13. The vapor extraction assembly of claim 12, wherein the humidity adjusting device includes a humidifier and a moisture separator and/or the temperature adjusting device includes a heating device and a cooling device.

14. The vapor extraction assembly of claim 11, wherein the vapor extraction hood includes an intake air connection at fluidly connected to outside air.

15. The vapor extraction assembly of claim 14, wherein the at least one parameter detected by the ambient condition sensor and/or the at least one parameter detected by the ambient condition sensor include an oxygen level.

16. The vapor extraction assembly of claim 15, wherein the control device or the air-conditioning regulating device is configured to regulate the flow of air through the intake air connection based on the oxygen level.

17. The vapor extraction assembly of claim 16, wherein the at least one parameter detected by the ambient condition sensor and/or the at least one parameter detected by the ambient condition sensor include a concentration of organic and/or inorganic gases and/or vapors.

18. The vapor extraction assembly of claim 17, further comprising an acoustic and/or optical warning device configured to output a warning signal in a manner controlled by the control device when a predefined parameter set-point value is exceeded.

19. A vapor extraction assembly comprising:

a vapor extraction hood having an intake side and an exhaust side opposite the intake side;

an air conduit connected to the exhaust side;

a blower device fluidly connected to the air conduit and configured to generate a flow of gas through the air conduit;

an outside air supply device fluidly connected to a source of outside air, the outside air supply device being integrally connected to the vapor extraction hood;

an ambient condition sensor for detecting at least one parameter of gas in an area surrounding the vapor extraction hood;

an extracted vapor condition sensor for detecting at least one parameter of gas within the vapor extraction hood;

at least one air-conditioning device mounted to the vapor extraction hood and configured to adjust the at least one parameter being detected by the ambient condition sensor;

an air-conditioning regulating device configured to control the at least one air-conditioning device based on the at least one parameter detected by the ambient condition sensor; and a control device configured to control the blower device to exhaust air out of the vapor extraction assembly through the air conduit based on the at least one parameter detected by the extracted vapor condition sensor.

20. The vapor extraction assembly according to claim 19, wherein the at least one air-conditioning device includes at least one of a humidifier, a moisture separator, a heating device and a cooling device.

21. The vapor extraction assembly according to claim 20, wherein the control device is configured to control a speed of the blower device.

22. The vapor extraction assembly of claim 21, wherein the at least one parameter detected by the ambient condition sensor and/or the at least one parameter detected by the ambient condition sensor include an oxygen level.

23. The vapor extraction assembly of claim 22, wherein the at least one parameter detected by the ambient condition sensor and/or the at least one parameter detected by the ambient condition sensor include a concentration of organic and/or inorganic gases and/or vapors.

24. The vapor extraction assembly of claim 23 wherein the control device or the air-conditioning regulating device is configured to regulate the flow of air through the intake air connection based on the oxygen level.

25. The vapor extraction assembly of claim 24, further comprising an acoustic and/or optical warning device configured to output a warning signal in a manner controlled by the control device when a predefined parameter set-point value is exceeded.

* * * * *